US007261189B2

(12) United States Patent
Kerscher et al.

(10) Patent No.: US 7,261,189 B2
(45) Date of Patent: Aug. 28, 2007

(54) BRAKING SYSTEM OF A RAIL VEHICLE

(75) Inventors: Albert Kerscher, Eching (DE); Erich Fuderer, Fürstenfeldbruck (DE)

(73) Assignee: Knorr-Bremse Systeme fur Schienenfahrzeuge GmbH, Munich (DE)

( * ) Notice: Subject to any disclaimer, the term of this patent is extended or adjusted under 35 U.S.C. 154(b) by 177 days.

(21) Appl. No.: 10/770,452

(22) Filed: Feb. 4, 2004

(65) Prior Publication Data

US 2004/0168867 A1 Sep. 2, 2004

(30) Foreign Application Priority Data

Feb. 6, 2003 (DE) ..... 103 04 715

(51) Int. Cl.
*F16D 55/08* (2006.01)
*B61H 13/00* (2006.01)

(52) U.S. Cl. ..... 188/72.7; 188/33; 188/106 F

(58) Field of Classification Search ..... 188/33, 188/34, 35, 42, 56, 73.1, 72.7, 72.8, 196 V, 188/106 F; 105/26.05, 27, 199.1; 74/523
See application file for complete search history.

(56) References Cited

U.S. PATENT DOCUMENTS

RE22,211 E * 10/1942 Eksergian ..... 188/153 R
3,101,814 A 8/1963 Newell
3,759,064 A * 9/1973 Jorn et al. ..... 464/93
4,537,137 A * 8/1985 White, Jr. ..... 105/72.2
4,843,973 A * 7/1989 Hartelius et al. ..... 105/26.1
5,026,248 A * 6/1991 Hamilton ..... 414/729
5,303,609 A * 4/1994 Iwanaga et al. ..... 74/523
6,186,284 B1 2/2001 Sauter et al.
6,948,595 B2 * 9/2005 Audren et al. ..... 188/72.8

FOREIGN PATENT DOCUMENTS

DE 42 17 231 A1 11/1993
GB 444996 4/1936
WO WO 00/02756 1/2000
WO WO-02057649 A1 * 7/2002

* cited by examiner

*Primary Examiner*—Melody M. Burch
(74) *Attorney, Agent, or Firm*—Barnes & Thornburg LLP

(57) ABSTRACT

A braking system of a rail vehicle includes a parking brake device having a gearing. The gearing converts a rotating movement initiated by rotation-actuating devices into an application of movement of at least one pressure-medium-operated cylinder piston drive. Also, included is at least one universal-joint shaft connecting the rotation-actuating devices with a gearing input of the gearing. The gearing input is disposed in the direct vicinity of the at least one piston cylinder drive and is connected to a nut screw drive converting a rotating movement at a gearing output of the gearing to a linear movement of a piston of the at least one cylinder piston drive.

25 Claims, 14 Drawing Sheets

BRAKING SYSTEM OF A RAIL VEHICLE

CROSS-REFERENCE

This non-provisional application claims benefit of and priority to German Application No. 103 04 715.8 filed Feb. 6, 2003 and the disclosure of which is hereby incorporated by reference herein.

BACKGROUND

The present disclosure relates to a braking system of a rail vehicle, including a parking brake device having a gearing which converts a rotating movement initiated by rotation-actuating devices to a linear application movement of at least one pressure-medium-operated cylinder piston drive.

Such a braking system is known, for example, from International Patent Document WO 00/02756 A1. The parking brake device is engaged by the rotation of a hand wheel, the rotating movement being converted to a linear movement by way of a screw drive arranged coaxial with respect to the hand wheel and in the direct vicinity of the latter. This linear movement has to be transmitted to a piston of the cylinder piston drive arranged away from the hand wheel and the screw drive, the position and alignment of the cylinder piston drive at the bogie being variable according to the type and construction of the rail vehicle. Flexible power transmission elements are therefore necessary, such as traction cables, flex ball cables or ball-bearing sheathed tension elements in order to deflect the linear movement into the respective position of the cylinder piston drive and to transmit it to the piston. However, the efficiency of such flexible power transmission elements decreases sharply in the course of the operating time, particularly under dusty and corrosive operating conditions. Furthermore, the bending radii of such flexible power transmission elements are limited as well as the tensile forces which can be transmitted by them. Furthermore, all power transmission elements have to be sufficiently dimensioned for a superpositioning force resulting from the service brake and parking brake force. This type of a solution is therefore relatively expensive.

SUMMARY

The present disclosure further develops a braking system of the initially-mentioned type. The present disclosure relates to a braking system of a rail vehicle including a parking brake device having a gearing. The gearing converts a rotating movement initiated by rotation-actuating devices into an application of movement of at least one pressure-medium-operated cylinder piston drive. Also, included is at least one universal-joint shaft connecting the rotation-actuating devices with a gearing input of the gearing. The gearing input is disposed in the direct vicinity of the at least one piston cylinder drive and is connected to a nut screw drive converting a rotating movement at a gearing output of the gearing to a linear movement of a piston of the at least one cylinder piston drive.

As a result of the fact that, instead of flexible power transmission elements, rigid universal-joint shafts are used, a very stiff power transmission takes place between the rotation-actuating devices and the gearing, which may be a toothed gearing. In addition, the universal-joint shafts represent standardized and cost-effective constructional elements with a favorable wear behavior which are suitable for transmitting high torques. Furthermore, because of the spatial vicinity of the toothed gearing, the screw nut drive and the cylinder piston drive, the power transmission path is short and direct. Since the superpositioning forces of the service brake and the parking brake are directly supported in the cylinder piston drive, the power transmission elements arranged in front of this unit can have smaller dimensions.

In a particularly preferable manner, the gearing and the nut screw drive are integrated in a housing of the cylinder piston drive or are combined with the latter to form a constructional unit, whereby, on the one hand, a very compact construction is obtained and, on the other hand, the gearing and the nut screw drive are protected from dirt and wear.

Preferably, the rotation-actuating devices comprise rotatably disposed hand wheels. For example, on both longitudinal sides of the vehicle, one hand wheel respectively is provided with an axis of rotation arranged essentially perpendicular to a longitudinal dimension of the rail vehicle, so that the parking brake device can be comfortably operated from both vehicle sides. If then, in addition, the universal-joint shafts are arranged essentially in a plane perpendicular to a longitudinal dimension of the rail vehicle, only a slight force deflection occurs with low deflecting losses.

The gearing may have two gearing inputs which are arranged to be mutually offset by 180 degrees and which are non-rotatably connected directly by one universal-joint shaft respectively with the assigned hand wheel. The universal-joint shafts then introduce the rotating movements of the hand wheels into the gearing without the intermediate connection of additional elements.

As an alternative, an intermediate gear can be arranged between the gearing and the hand wheels, for converting the rotating movements brought forward by the universal-joint shafts to a rotating movement of at least one other universal-joint shaft connected with the gearing input of the gearing, the intermediate gear being constructed such that it converts rotating movements of the input-side universal-joint shafts in the same direction to a rotating movement of the output-side universal-joint shaft.

According to an embodiment of the present disclosure, the at least one cylinder piston drive extends essentially in the longitudinal dimension of the rail vehicle. In this case, the gearing is preferably formed by a bevel gearing, for deflecting the rotating movement of the universal-joint shaft or universal-joint shafts into a rotating movement about an axis parallel or coaxial to the piston of the cylinder piston drive. In comparison, for example, to worm gearings, which can also be used as gearings or toothed gearings, bevel gearings have a higher efficiency and are therefore best suitable for the present case of a locking power generated by manual force. The bevel gearing has, for example, a bevel pinion non-rotatably connected with one end of a universal-joint shaft as well as a bevel gear meshing with this bevel pinion, a nut of the nut screw drive being non-rotatably connected with the bevel gear of the bevel gearing, and a screw of the nut screw drive being constructed such that it can strike against the piston. This can take place, for example, in that the screw of the nut screw drive is guided so that it can be coupled with the piston by a cone clutch and can be axially displaced with respect to the piston non-rotatably supported at a housing, but is non-rotatable, for example, by a polygon profile. The reaction torque is absorbed by the polygon profile, which reaction torque results from the screwing of the nut on the screw. In addition, it permits an exact guidance of the screw until it comes in contact with the piston. Finally, these kinematics allow that the parking brake device can be operated also when the service brake is applied and the piston can also be held in the brake application position after the releasing of the service brake.

According to another embodiment of the present disclosure, the at least one cylinder piston drive extends essentially perpendicular to the longitudinal dimension of the rail vehicle. In this case, the gearing is preferably formed by a spur gearing which transmits the rotating movement in parallel and, on the output side, drives an axially fixed and rotatably disposed sleeve in which the nut of the nut screw drive is disposed so that it can be axially displaced and can rotate along. This results in a floating bearing of the nut screw drive, so that the latter can be axially displaced in order to compensate a different brake block play on the right and the left wheel during service braking.

According to a further development of this embodiment, two coaxial cylinder piston drives are provided which work in opposite directions, in which case the screw of the screw nut drive is constructed on the thrust side of the piston of one cylinder piston drive and the nut of the screw nut drive is constructed so that it can strike against the thrust side of the piston of the other cylinder piston drive. Furthermore, the screw is disposed in a linearly displaceable and torsion-protected manner on the piston of one cylinder piston drive, and the nut is disposed in a linearly displaceable but freely rotatable manner on the piston of the other cylinder piston drive, for example, in that a guide for the screw and for the nut is constructed inside one centric cup-shaped shaped-out section respectively in the assigned piston. For actuating the pistons, the screw and the nut are equipped at the end side with one stop body respectively shaped complementary to a bottom of the shaped-out sections of the pistons.

The braking system may be constructed as a brake module fastened in a hanging fashion on a bogie by hanging lugs and includes two brake beams each assigned to a wheel axle with two wheels respectively and extending parallel thereto, which brake beams are mutually connected by way of pressing rods and carry brake blocks which, by the actuation of the cylinder piston drives, can be brought into a braking engagement with assigned braking areas of the wheels. In this case, preferably at least a portion of one of the brake beams directly forms the cylinders of the cylinder piston drives as well as the housing for the gearing and for the nut screw drive. Because at least a portion of one of the brake beams itself represents the cylinder of the cylinder piston drive or the housing for the gearing and the nut screw drive, the present disclosure goes farther than the initially mentioned state of the art, in which the cylinder of the cylinder piston drive is carried as a separate component by the brake beam which is also constructed as a separate component. In contrast, according to the present disclosure, at least one of the brake beams actually intended for holding the brake blocks and for transmitting the contact pressure force at the same time forms the cylinder of the cylinder piston drive or vice-versa, so that, in comparison to the state of the art, fewer components have to be produced and mounted. The present disclosure represents a self-supporting construction of the cylinder piston drives.

These and other aspects of the present disclosure will become apparent from the following detailed description of the disclosure, when considered in conjunction with accompanying drawings.

DETAILED DESCRIPTION

Figure 1:
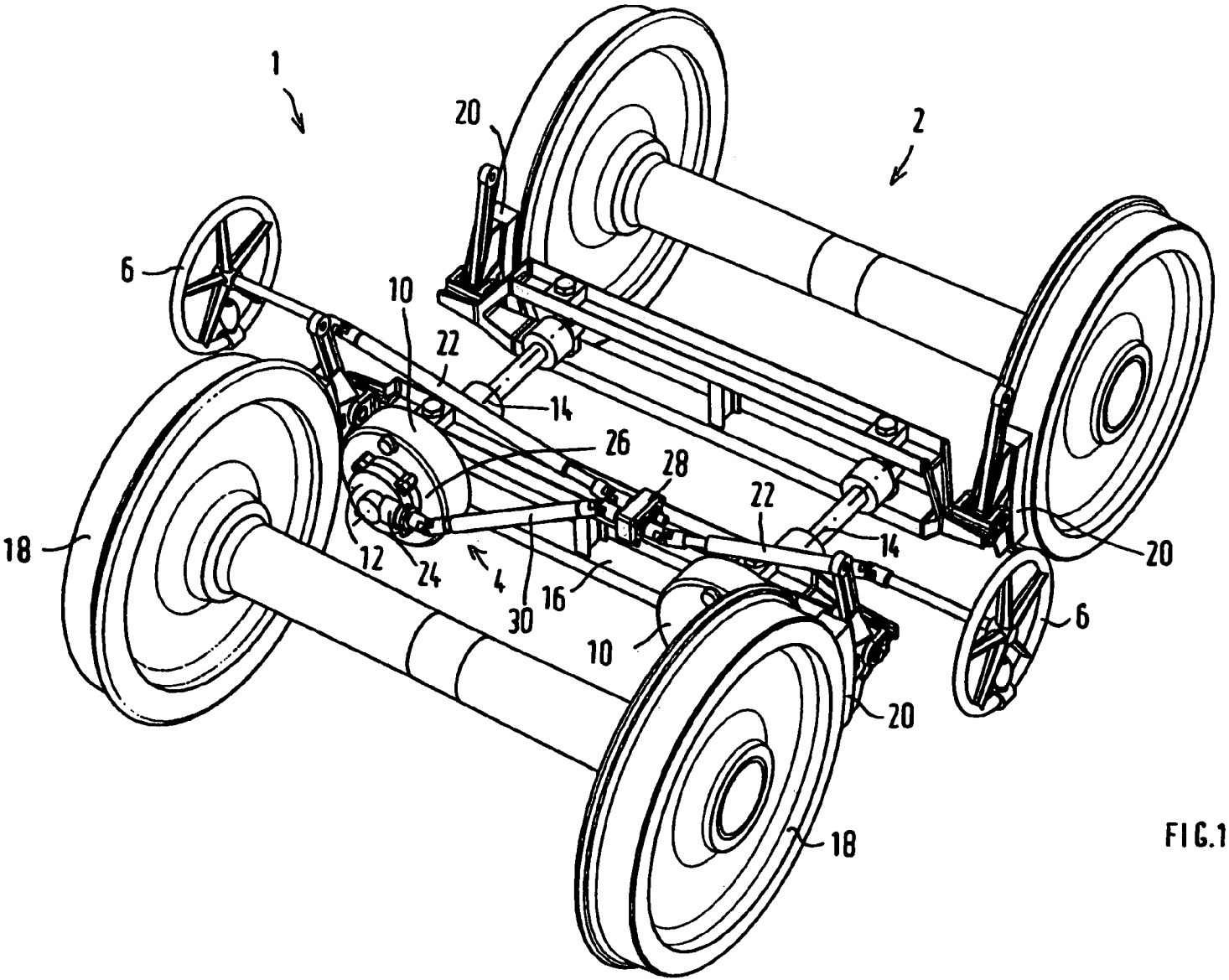
FIG. 1 is a perspective view of a shoe braking system of a railroad freight car according to a first embodiment of the present disclosure.

In FIG. 1, reference number 1 indicates a first embodiment of a shoe braking device or brake system of a rail road freight car (not shown) which is fastened as a hanging brake module to a bogie 2 of the railroad freight car. The shoe braking device or brake system 1 includes a parking brake device 4 having a gearing 12, which may have teeth, and which converts a rotating movement initiated by rotation-actuating devices 6 to a linear movement of a brake application element of a pressure-medium-operated actuator or cylinder piston drive 10. The shoe braking device 1 includes at least one but, preferably, may have two cylinder piston drives 10 having center axes 14 extending in a longitudinal dimension of the railroad freight car, both cylinder piston drives 10 being held at a transverse distance from one another at ends of a brake beam 16. The cylinder piston drives 10 operate brake blocks 20 of the shoe braking device 1. Preferably, only one of the two cylinder piston drives 10 may include a parking brake device 4, or both cylinder piston drives 10 may have one parking brake device 4, respectively. However, of these, the parking brake device 4 of only one cylinder piston drive 10 may be operated.

As illustrated in FIG. 1, the rotation-actuating devices 6 of the parking brake device 4 comprise one rotatably disposed hand wheel 6 on both longitudinal sides of the vehicle, with an axis of rotation of the hand wheel 6 arranged essentially perpendicular to the longitudinal dimension of the railroad freight car, as well as input-side universal-joint shafts 22 for transmitting the rotating movement introduced at the hand wheels 6 into a gearing input 24 of the gearing 12. The hand wheels 6 are rotatably disposed on the bogie 2 by bearings, which are not shown for reasons of clarity. Between the gearing 12, integrated in a housing 26 of the cylinder piston drive 10, and the hand wheels 6, for example, an intermediate gearing or gear 28 is arranged which is held on the brake beam 16, for converting the rotating movements of the hand wheels 6 brought forward by the input-side universal-joint shafts 22 to a rotating movement of an output-side universal-joint shaft 30 connected with the gearing input 24 of the gearing 12. This intermediate gearing 28 is constructed such that it converts rotating movements of the input-side universal-joint shafts 22 in the same direction to a rotating movement of the output-side universal-joint shaft 30. As a result, it is ensured that the parking brake device 4 can be applied or released only by a rotation of the hand wheels 6 in the same direction. Preferably, the parking brake device 4 is applied by rotating one or both of the hand wheels 6 clockwise and is released by a counterclockwise rotation. However, the parking brake devices 4 of both cylinder piston drives 10 can be operated if the intermediate gearing 28 is constructed as a differential distributor gearing.

The universal-joint shafts 22 and particularly the output-side universal-joint shaft 30 of the intermediate gearing 28 are essentially situated in planes which are arranged perpendicular to the center axis 14 of the cylinder piston drive 10. In addition, the center axis 14 of the cylinder piston drive 10 is arranged to be offset by a distance in the downward direction in comparison to the axes of rotation of the hand wheels. As a result, a deflection of the rotating movements takes place only in these planes. The universal-joint shafts 22, 30 preferably have two joints respectively.

Figure 2:
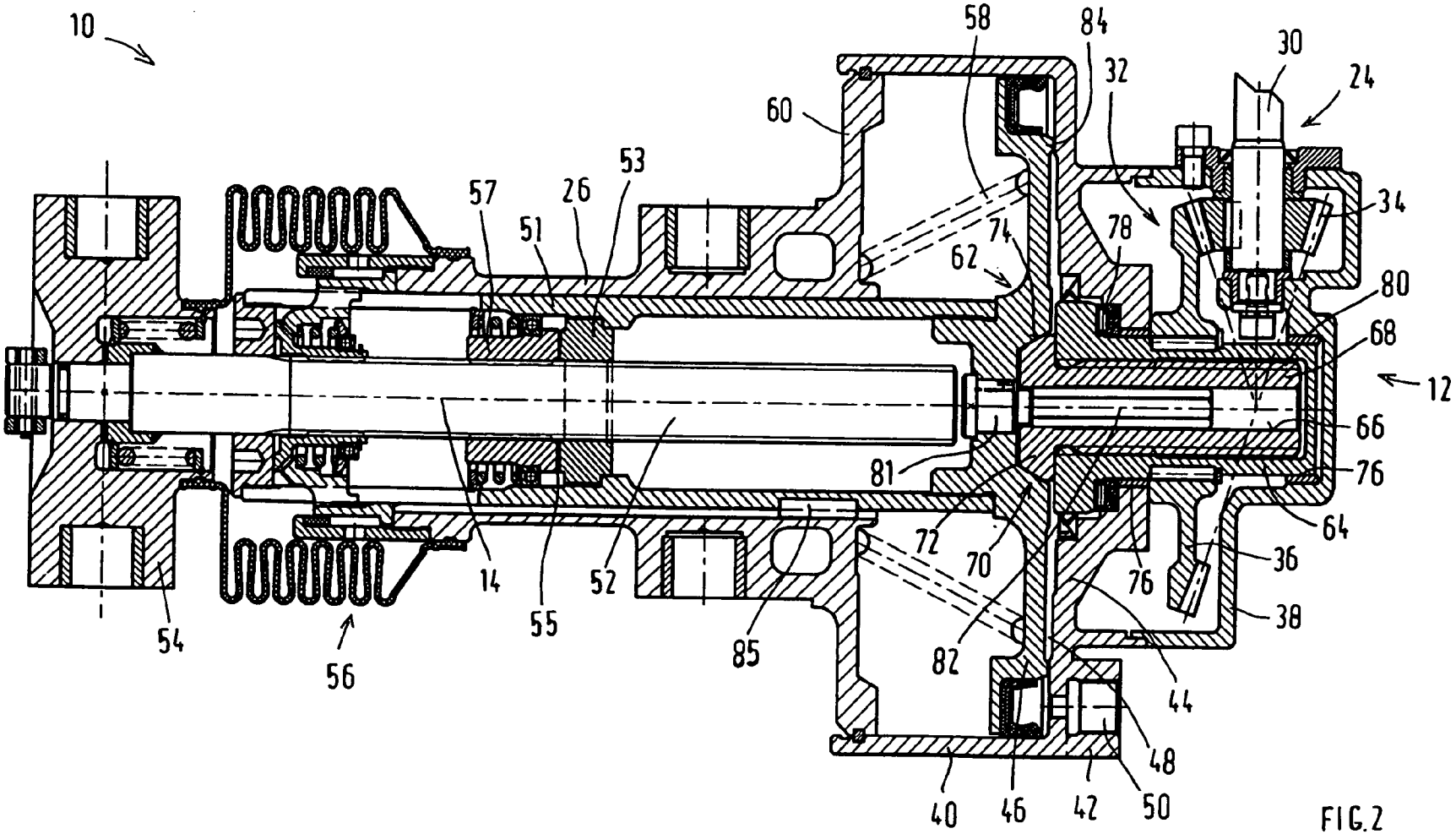
FIG. 2 is a sectional view of a cylinder piston drive of the braking system of FIG. 1 with an integrated parking brake device in the release position.

As mentioned above, the gearing 12 converting rotating movements to a linear movement of the brake application element is integrated in the housing 26 of the cylinder piston drive 10 or is combined with the latter to a constructional unit. The gearing 12 may include a toothed gearing in the form of a bevel gearing 32 for deflecting the rotating movement of the universal-joint shaft 30 on the output side with respect to the intermediate gearing 28 to a rotating movement about an axis which is parallel or coaxial with respect to the application direction of the brake application element, as illustrated in FIG. 2. In the present case, this axis is formed by the center axis 14 of the cylinder piston drive 10. The universal-joint shaft 30 on the output side, with respect to the intermediate gearing 28, projects, while forming a gearing input 24, perpendicular to the center axis 14 of the cylinder piston drive 10, into its housing 26. On the end side, it carries a bevel pinion 34 of the bevel gearing 32 non-rotatably connected with it, which bevel pinion 34 meshes with a bevel gear 36 of the bevel gearing 32 disposed coaxially with respect to this center axis 14. The bevel gearing 32 is accommodated in a housing part 38 of the housing 26 of the cylinder piston drive 10, which is axially attached to another cylinder housing part 42 including the brake cylinder 40 of the cylinder piston drive 10. A pressure chamber 48 formed between a bottom 44 of the brake cylinder 40 and a piston 46 guided in this brake cylinder 40 coaxial to the center axis 14 can be ventilated or bled by compressed air by way of a connection 50 constructed in the cylinder housing part 42. The axial force acting upon the piston 46 is transmitted by way of a piston tube 51 centered at the piston 46 and in a rotationally and axially fixed manner held on the latter to a ring 53 axially supported in this piston tube 51 on a step, and transmitted by this ring 53 by way of a contrate gearing 55 to a forcing nut 57 which, in turn, is connected by way of a self-locking thread with a piston rod 52 coaxial to the center axis 14 and particularly to the piston 46. On the sides pointing away from the gearing 12, the piston rod 52 projects out of the cylinder housing part 42 and is provided on the end side with a yoke 54 by which the brake blocks 20 are applied. Furthermore, a wear adjusting device 56 is accommodated in the cylinder housing part 42. By way of a preferably conical coil spring 58, the piston 46 is supported on another bottom 60 of the cylinder housing part 42.

In addition, the gearing 12 includes a nut screw drive 62 which is arranged behind the bevel gearing 32, is coaxial with respect to the center axis 14 and of which a screw nut 64 is non-rotatably connected with the bevel gear 36 of the bevel gearing 32, and a screw 68 preferably provided with an axial passage bore 66 and forming a gearing output can be supported on the piston 46 in the brake application direction. The supporting preferably takes place by a cone clutch 70 narrowing in the operating or in the brake application direction. The screw 68, on the end side, has a conical button 72 which is enlarged in its diameter and is constructed so that it can engage in a complementarily conically shaped central recess 74 of the piston 46. As a result, the screw 68 forming the gearing output of the gearing 12 is situated directly opposite the brake application element of the cylinder piston drive 10 formed by the piston 46.

The screw nut 64 is radially, by way of a slide bearing 76, and axially, by way of a needle bearing 78, radially disposed in the housing 26. The screw 68 of the nut screw drive 62 can be axially screwed by way of thread devices, preferably by way of a self-locking trapezoidal thread 80 with respect to the screw nut 64. Furthermore, the screw 68 is constructed to be axially displaceable but non-rotatable with respect to the piston 46. This can, for example, be implemented in that a rod 81 is pressed in a pressure-sealed manner into a central bore in the piston 46, which rod 81 is provided on a section 82 pointing to the nut screw drive 62 with an external polygon profile, such as an external hexagon profile, which engages into a complementarily constructed internal polygon profile of the passage bore 66 of the screw 68. In the release position of the parking brake device 4 illustrated in FIG. 2, which simultaneously is the release position of the service brake, as a result of the effect of the coil spring 58, the piston 46 rests by way of an axially projecting stop ring 84 against the bottom 44 of the cylinder housing part 42.

Against this background, the method of operation of the shoe braking device 1 of the railroad freight car is as follows: When the service brake is not applied, that is, when the pressure chamber 48 is bled, the parking brake device 4 is to be brought from the release position illustrated in FIG. 2, into the brake application position. For this purpose, one or both hand wheels 6 are rotated clockwise, the rotating movement being transmitted by way of the two universal-joint shafts 22 to the intermediate gearing 28 and being further transmitted to the output-side universal-joint shaft 30. By the bevel gearing 32, the rotating movement originally introduced about an axis of rotation perpendicular to the center axis 14 of the cylinder piston drive 10 is deflected into a rotating movement of the bevel gear 36 coaxial to this center axis 14 and is transmitted to the screw nut 64 non-rotatably connected with the bevel gear 36. In this case, the moment of reaction acting as a result of the screwed connection of the screw nut 64 on the screw 68 is supported by way of mutually engaging polygon profiles or splines of the screw 68 and the rod 81 at the piston 46 which, in turn, is non-rotatably held in the housing 26 by adjusting springs 85 applied to the piston tube 51. As a result of the rotation of the screw nut 64 disposed in the housing 26, the screw 68 is screwed out of the screw nut 64 in the brake application direction and, by way of the cone clutch 70 closed by the button 72 pressed into the recess 74, moves the piston 46 against the effect of the coil spring 58 into the brake application position. Here, the movement of the piston 46 is transmitted by way of the piston tube 51, the ring 53, the forcing nut 57 and the piston rod 52 to the yoke 54 fastened to this piston rod 52 at the end side, which yoke 54 actuates the shoe braking device 1. This situation is illustrated in FIG. 3.

Figure 3:
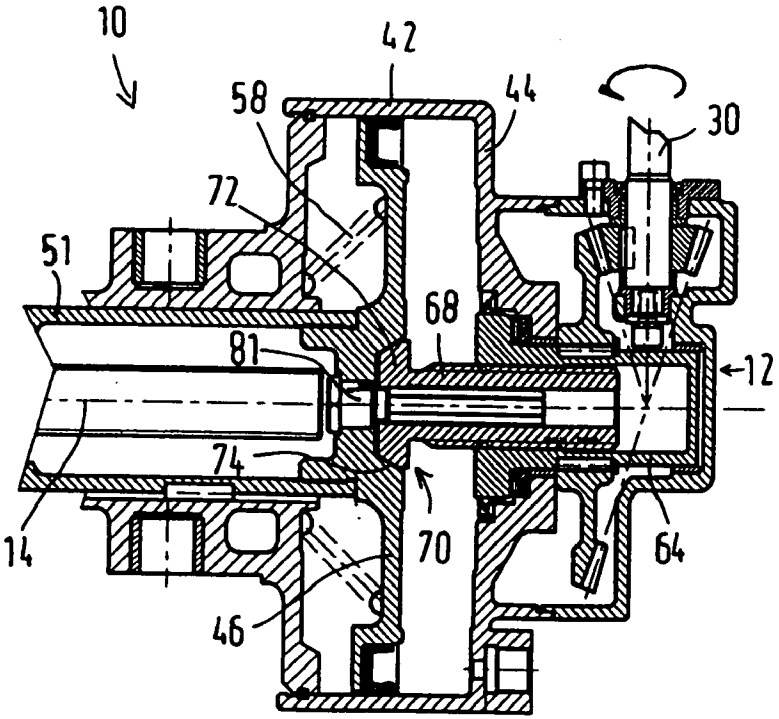
FIG. 3 is a sectional view of a portion of FIG. 2 with the parking brake device applied.

In FIG. 3, it can be seen that an operation of one or both hand wheels 6 (see FIG. 1) in the opposite direction results in a rotation of the output-side universal-joint shaft 30 in the opposite direction, which, in turn, causes a screwing of the screw 68 into the screw nut 64, whereby the piston 46 supported by way of the cone clutch 70 on the screw 68 is pushed back by the effect of the coil spring 58 into the release position, as shown in FIG. 2. The piston 46 strikes against the bottom 44 of the cylinder housing part 42, and a face of the button 72 of the screw 68 pointing to the screw nut 64 strikes against a face of the screw nut 64. In this case, the screw 68 is completely screwed into the screw nut 64, and although the button 72 is still accommodated in the recess 74 of the piston 46, it no longer exercises a force upon it in this position. In the case of the approach described so far, the service brake was not applied during the application and release of the parking brake device 4.

Figure 4:
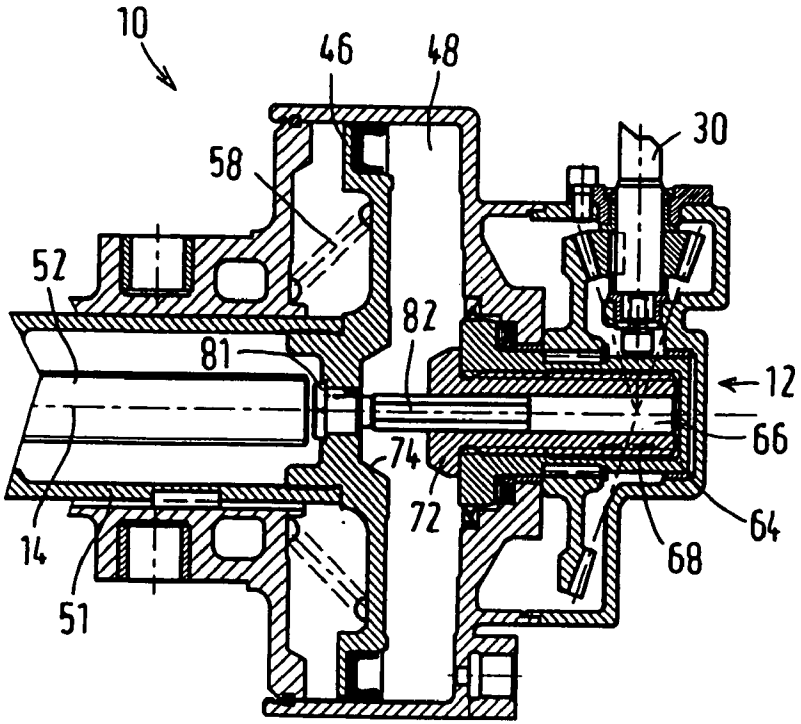
FIG. 4 is a sectional view of a portion of FIG. 2 with the parking brake device released and the service brake applied.

In contrast, FIG. 4 shows a situation in which the service brake is applied by the pressurizing of the pressure chamber 48, the piston 46 having been brought into the brake application position against the effect of the coil spring 58. While the parking brake device 4 is simultaneously released, the screw 68 is completely screwed into the screw nut 64. As illustrated, the piston 46 is axially spaced away from the button 72 of the screw 68, and the section 82 of the rod 81 provided with the polygon profile is moved a distance out of the passage bore 66 of the screw 68, so that the cone clutch 70 is released. The parking brake can be engaged even when the service brake is in the brake application position. Based on the situation illustrated in FIG. 4, this can take place in that, as a result of the actuating of the hand wheels 6, the screw 68 is screwed out of the screw nut 64 until its button 72 engages in the recess 74 of the piston 46 and holds the latter in the brake application position even when the pressure chamber 48 has already been bled again for releasing the service brake.

Figure 5:
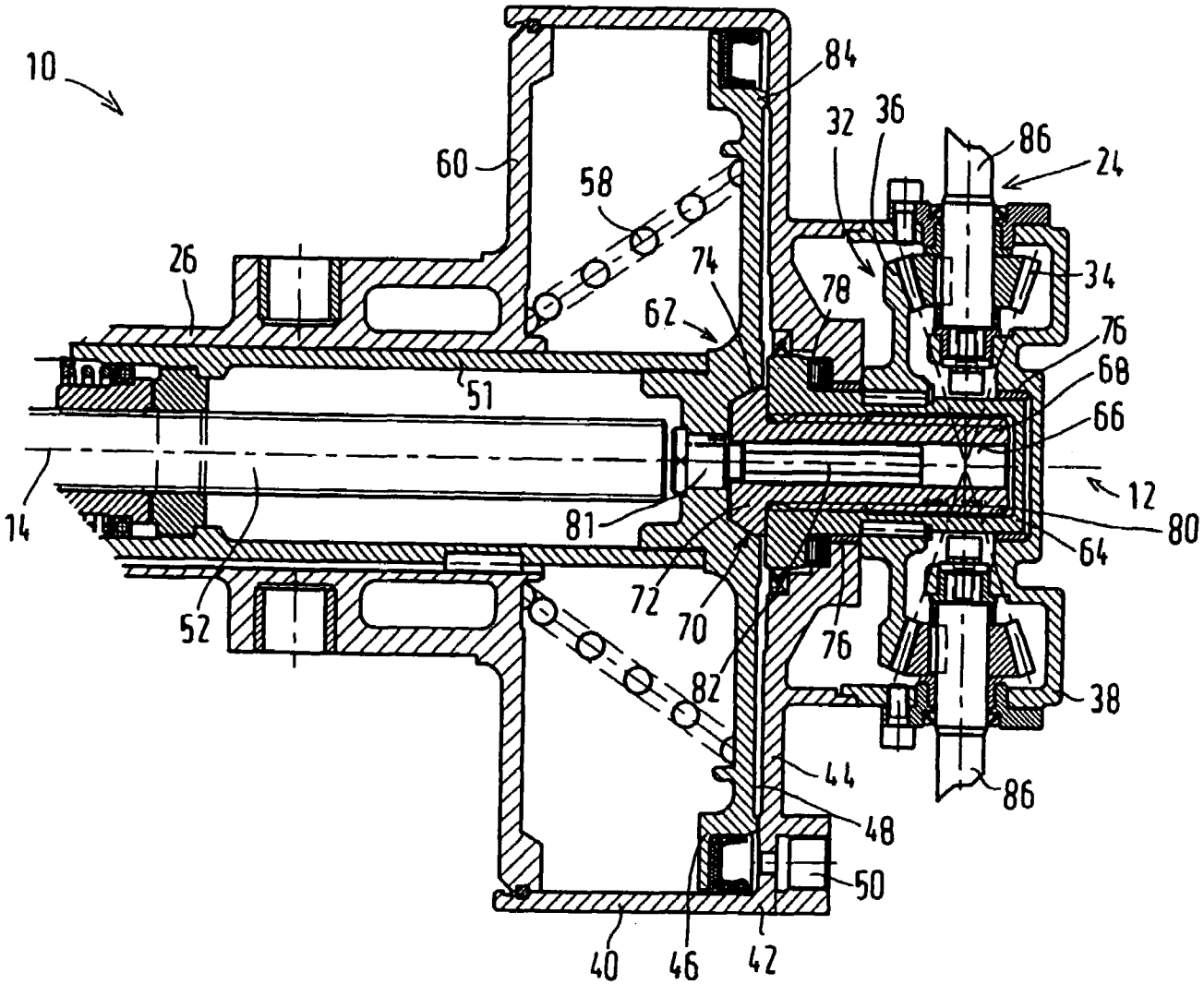
FIG. 5 is a sectional view of a cylinder piston drive with an integrated parking brake device according to a second embodiment of the present disclosure.
Figure 6:
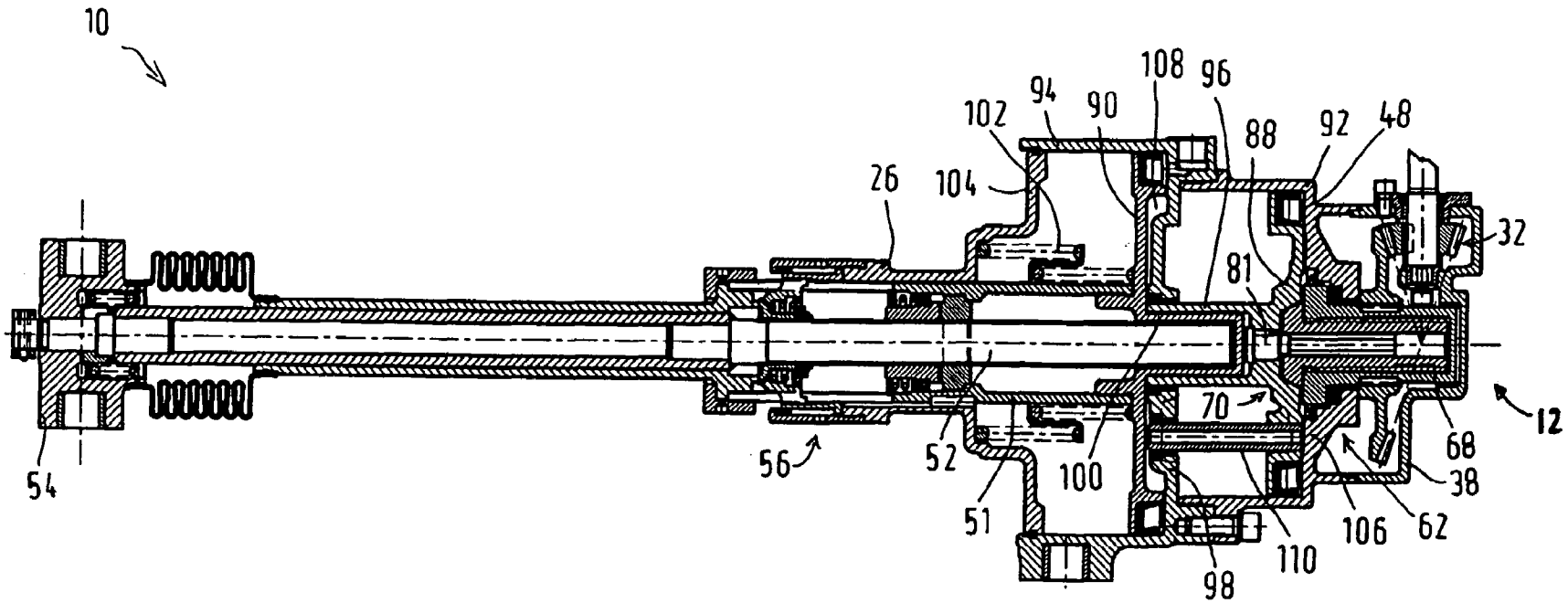
FIG. 6 is a sectional view of a cylinder piston drive with an integrated parking brake device according to a third embodiment of the present disclosure.

In the further embodiments of the invention according to FIGS. 5 and 6, the parts which have remained the same or have the same effect as in the preceding embodiment are provided with identical reference numbers. In contrast to the first embodiment, the gearing 12 according to the embodiment of FIG. 5 has two gearing inputs arranged offset with respect to one another by 180°; the gearing input being formed by one universal-joint shaft 86, respectively. The two universal-joint shafts 86 are non-rotatably connected without the intermediate connection of an intermediate gearing 28 directly with the assigned hand wheel 6. The universal-joint shafts 86, in turn, are arranged in a plane perpendicular to the center axis 14 of the cylinder piston drive 10. In this case, each universal-joint shaft 86 carries one bevel pinion 34, respectively, at the end side, which bevel pinion 34 meshes with the bevel gear 36 of the bevel gearing 32. Otherwise, the gearing 12 and particularly the cylinder piston drive 10 are constructed as described in the preceding embodiment.

In the third embodiment according to FIG. 6, the cylinder piston drive 10 comprises a tandem cylinder having two pistons, of which a first piston 88 can be supported against the screw 68 of the nut screw drive unit 62, and a second piston 90 can be supported axially and particularly in the brake application direction against the first piston 88. Specifically, the housing 26 of the cylinder piston drive 10 is divided into three housing parts, of which one housing part 38, which points away from the yoke 54 of the piston rod 52, accommodates the bevel gearing 32 and a portion of the nut screw drive 62; a first cylinder housing part 92, which axially adjoins the housing part 38, accommodates the first piston 88; and a second cylinder housing part 94, which, in turn, axially adjoins the latter, accommodates the second piston 90.

On the screw side, the first piston 88 is constructed as described in the preceding embodiments. In addition, it is equipped with a piston tube 96 pointing to the second piston 90, which piston tube 96 is sealingly guided, on the one side, between a bottom 98 of the second cylinder housing part 94 and a piston tube 100 engaging therein which is part of the second piston 90. The two pistons 88, 90 transmit the axial force acting upon them to the piston rod 52. The piston tube 96 of the first piston 88 is supported on the face side on a second piston 90 which, in turn, is supported by cylindrical coil springs 102 on another bottom 104 of the second cylinder housing part 94. A pressure chamber 48, 108 is in each case constructed between the bottoms 98, 106 of the two cylinder housing parts 92, 94 and the assigned pistons 88, 90. The two pressure chambers 48, 108 are connected with one another by several hollow bolts 110 arranged at a circumferential distance from one another, the hollow bolts 110. On the one hand, the bolts 110 are displaceably arranged in passage holes of the bottom 98 of the second cylinder housing part 94 and, on the other hand, are pressed in a pressure-sealed manner in passage holes coaxial thereto in the first piston 88. The hollow bolts 110 held on the housing 26 are, in addition, supported in a double function on the first piston 88 in the circumferential direction when torque is transmitted to it by the screw 68. When the hand wheels 6 are operated in the brake application direction, the application force transmitted by way of the cone clutch 70 to the first piston 88 is transmitted to the piston tube 96 to the second piston 90 and, from there, is guided by way of the wear adjusting device 56 to the yoke 54.

Figure 7:
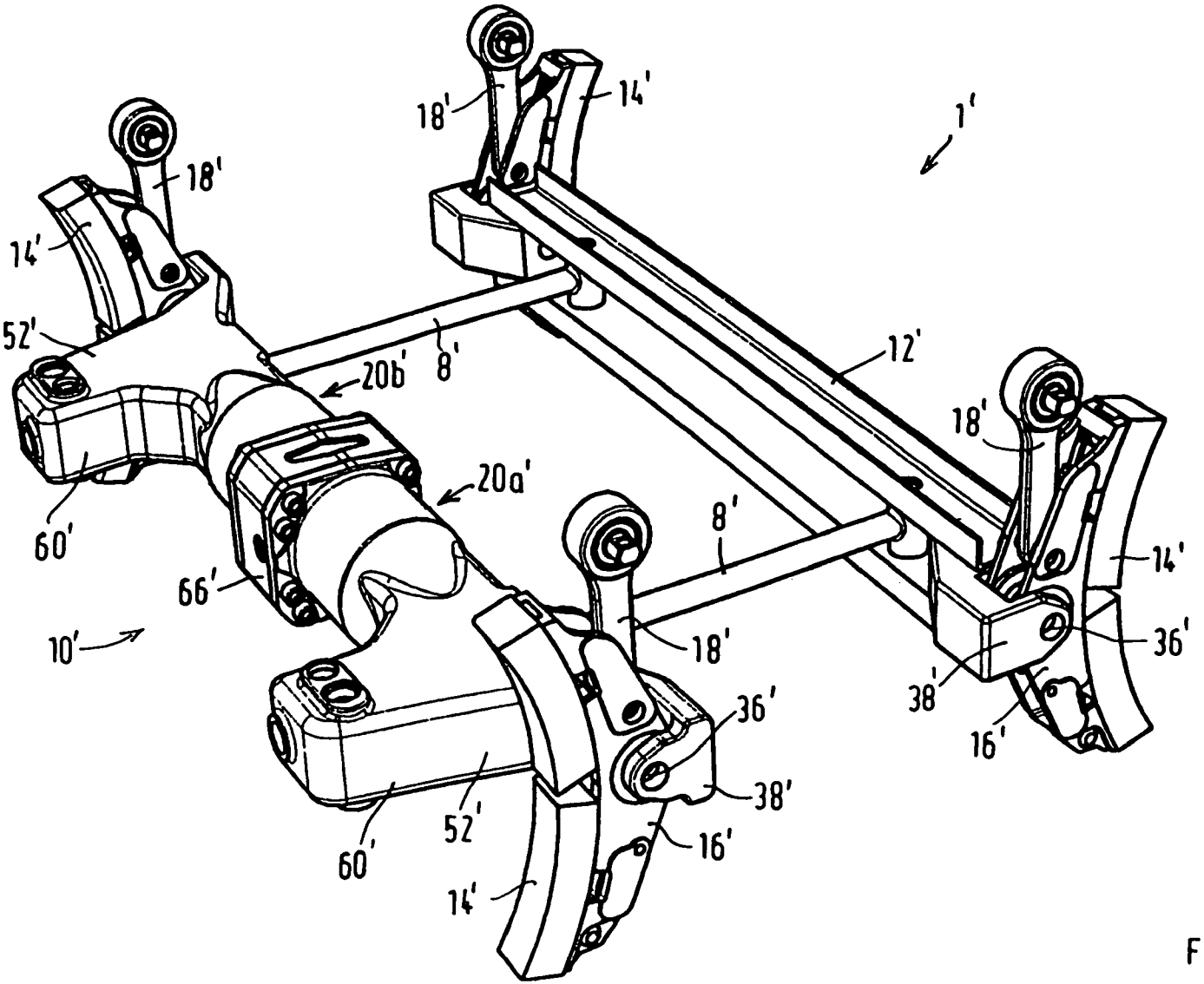
FIG. 7 is a perspective view of a shoe braking system according to a fourth embodiment of the in present disclosure with a brake beam in the form of a housing which simultaneously forms the cylinders of cylinder piston drives.
Figure 16:
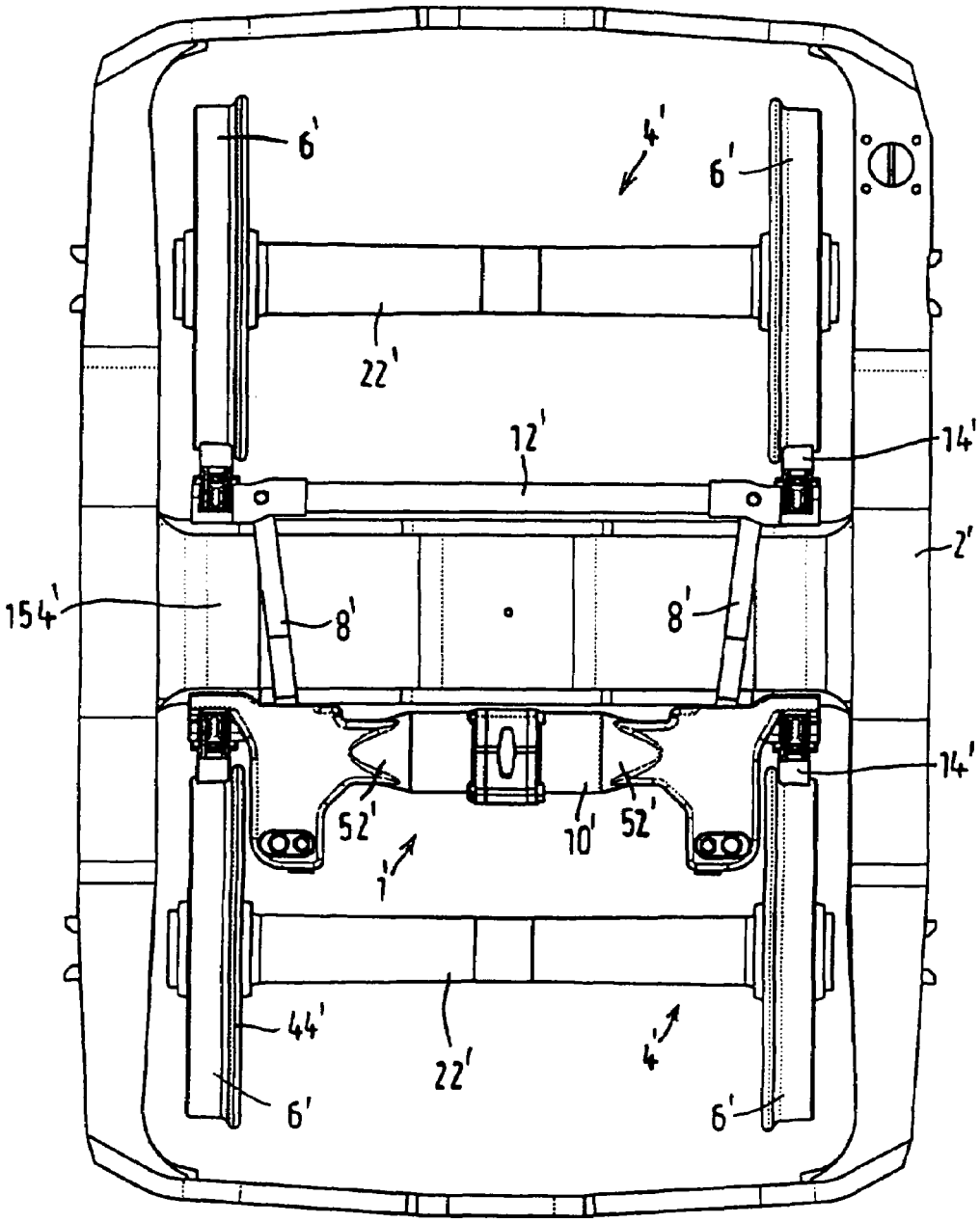
FIG. 16 is a view from below of a bogie with a shoe braking device, according to another embodiment of the present disclosure.

FIG. 7 shows another embodiment of a shoe braking device 1'. As a whole, the shoe braking device 1' is fastened in a hanging manner to a bogies 2' of a railroad freight car illustrated in FIG. 16. As shown in FIG. 16, bogies 2' has two wheel sets 4' with two wheels 6' respectively. The shoe braking device 1' preferably comprises: two brake beams 10', 12' mutually connected by pressing rods 8'; four brake shoes 16' held on the end side on the brake beams 10, 12' and carrying brake blocks 14'; four hanging lugs 18' linked, on the one side, to the brake beams 10', 12' and, on the other side, to the bogie 2'; as well as, for example, two brake actuators **20*a*', 20*b*' (similar functionally to the previously noted cylinder piston drive 10) which are accommodated in one brake beam 10' constructed as a hollow housing, which brake actuators 20*a*', 20*b*' are indicated but not visible in FIG. 7. The brake blocks 14' of a brake beam 10', 12' are assigned to the wheels 6' of a wheel axle 22', the brake beams 10', 12' extending approximately parallel to the wheel axles 22'. The two wheel sets 4' are spring-mounted in a known manner with respect to the bogie 2'. The spring mounting makes it possible that the two wheel sets 4', among other things, can carry out longitudinal and transverse movements relative to the bogie 2'**.

By the action of the pressure medium upon cylinder piston drives 20*a*', 20*b*' or the brake actuators, the pressing rods 8' are actuated such that the brake beams 10', 12' are moved away from one another and the brake blocks 14' carried by them are thereby moved into a brake application position against the wheels 6'. According to the embodiment of FIG. 7, the pressing rods 8' are arranged essentially perpendicular to the brake beams 10', 12'.

Figure 15:
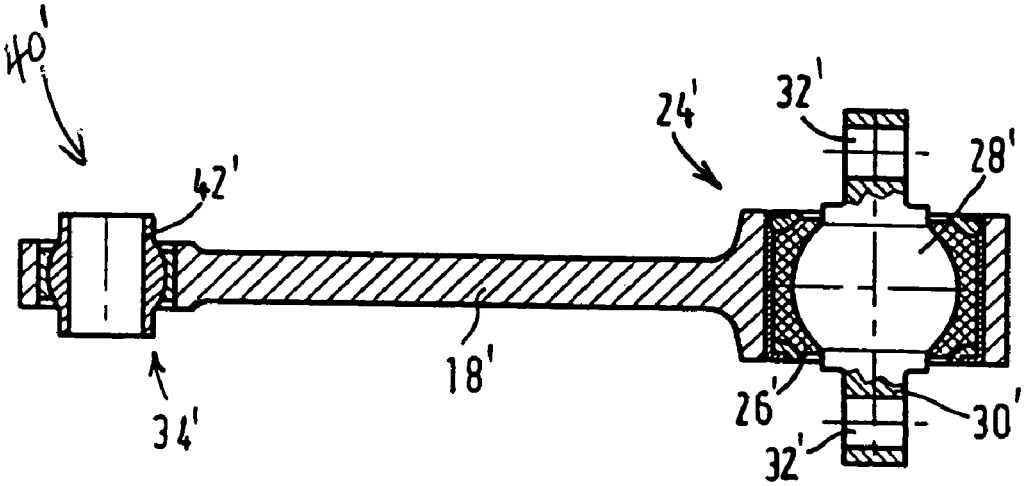
FIG. 15 is a sectional view of an individual hanging lug.

As shown in FIG. 7, the hanging lugs 18' are swivellably disposed on the bogie 2'. They may be swivellably disposed on all sides. As shown in FIG. 15 of an individual hanging lug 18', a spheroidal block 24' is used as a swivel bearing; that is, a spherical head 28' of a ball pin 30' is disposed inside a rubber sleeve 26' with a complementarily spherical bearing surface. The ball pin 30' is preferably constructed as a flat pin with two passage bores 32' at the ends, the flat pin 30' being preferably accommodated in a longitudinal beam of the bogie 2', which longitudinal beam is not shown in FIG. 15. The bearing of the hanging lugs 18', which is swivellable on all sides, on the one hand, makes it possible for the brake beams 10', 12', together with the brake blocks 14', to follow the transverse movements of the wheel sets 4' in the direction of the wheel axles 22' in order to ensure that they are always situated opposite the braking areas of the wheels 6'. On the other hand, the spherical block 24' permits a swivelling of the hanging lugs 18' in the longitudinal or driving direction. Such a swivelling motion takes place, for example, when the brake actuators 20*a*', 20*b*' are operated and consequently the wheel-side ends 34' of the hanging lugs 18' move transversely with respect to the wheels axles 22' away from one another or toward one another. Furthermore, such a rotating possibility has to be provided for the hanging lugs 18' in order to be able to compensate the wear occurring at the brake blocks 14'. The hanging lugs 18' therefore have to be swivellable in at least two degrees of rotational freedom with respect to the bogies 2', which can be implemented by any type of spherical bearing or by a sufficiently large play of the bearing of the hanging lugs 18' at the bogie 2'. The rubber sleeve 26' surrounding the spherical head 28', because of a restoring moment resulting from its elasticity, has the effect that the shoe braking device 1' returns into its initial position during the transition from the application position into the release position, in which initial position the brake blocks 14' are away by almost the same distance from the assigned braking areas of the wheels 6.

As best illustrated in FIG. 7, the brake shoes 16' carrying brake blocks 14' are swivellably linked to the brake beams 10', 12' about swivelling axes extending parallel to the wheel axles 22'. As a result, the brake shoes 16' can be tilted and, during the braking, can place themselves in a position-optimal manner against the braking areas of the wheels 6'. The swivel bearing is implemented, for example, by brake shoe bolts 36' which are fitted through passage bores in fork-shaped receiving devices 38', each arranged at the end side on the brake beams 10', 12' and reaching around the brake shoes 16'. They may also be fitted through a central passage bore of the respective brake shoe 16'.

Preferably the hanging lugs 18' are linked with their wheel-side end 34' directly to the brake shoes 16' by another spherical bearing 40' which comprises, for example, a spherical sleeve 42' disposed in the hanging lug 18', which sleeve 42' is fastened by a hanging lug bolt on the assigned brake shoe 16', as illustrated in FIG. 15. These kinematics permit an inclination of the hanging lugs 18' during transverse movements of the wheel axles 22', while the brake shoes 16', which are laterally situated at the radially projecting wheel flanges 44' of the wheels 6' and continue to be held in a perpendicular position by the brake shoe bolt, in the wheel plane remain aligned essentially parallel to the wheel braking area.

Figure 9:
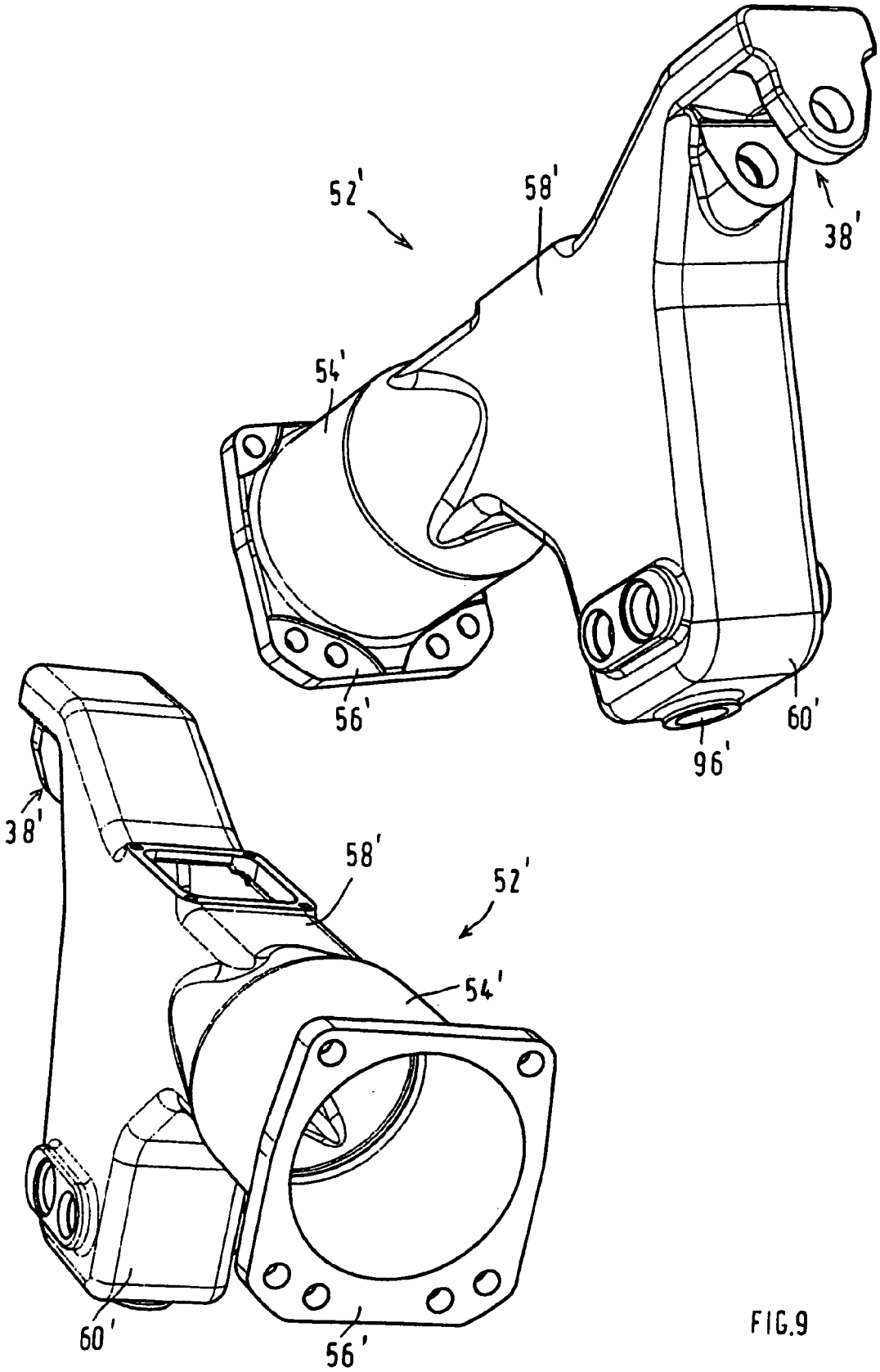
FIG. 9 is a perspective view of housing halves of the brake beam of FIG. 7.
Figure 10:
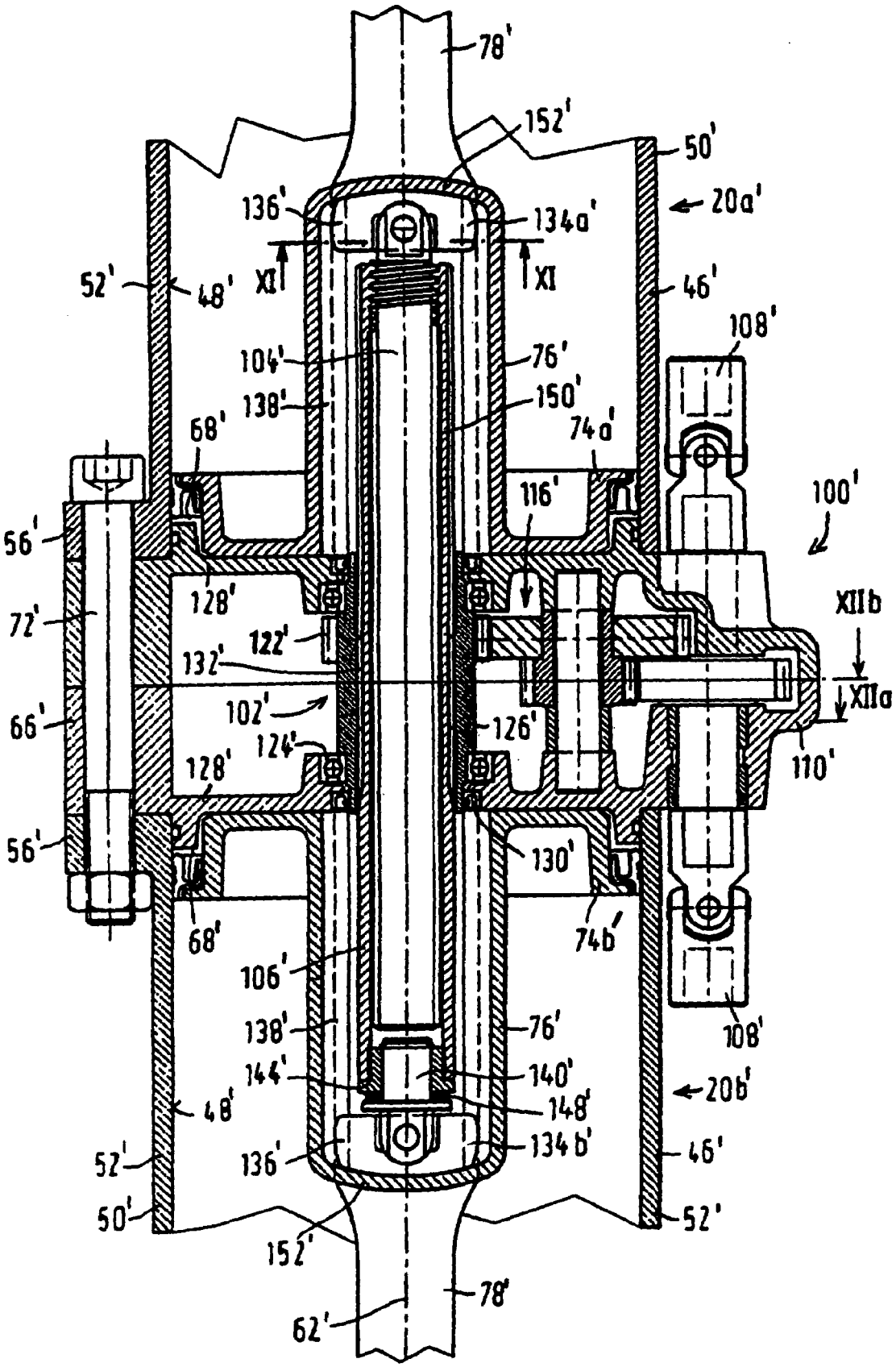
FIG. 10 is a sectional view of the cylinder piston drives with an integrated parking brake device.
Figure 12A:
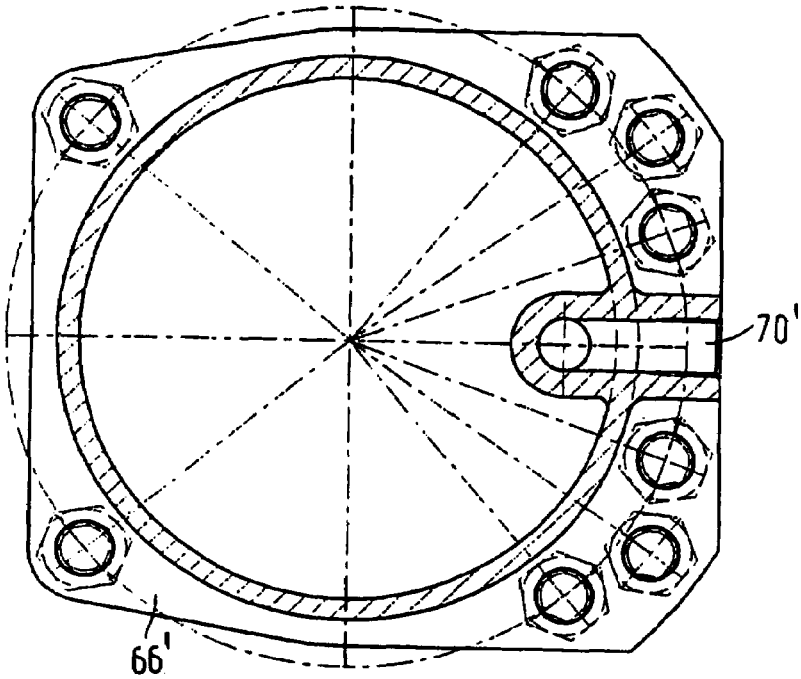
FIG. 12*a* is a sectional view along Line XIIa of FIG. 10.

In the one brake beam 10' constructed as a hollow housing, two coaxial cylinder piston drives 20*a*', 20*b*', which operate in opposite directions, are integrated. In this case, at least sections of the brake beam 10' itself form the cylinders 46' of the cylinder piston drives 20*a*, 20*b*, as illustrated particularly in FIG. 8. More precisely, the cylinder faces 48' of the cylinders 46' of the cylinder piston drives 20*a*', 20*b*' are preferably constructed directly by an interior circumferential surface of the wall 50' of the hollow brake beam 10'. As an alternative, the cylinder faces 48' can also be formed by cylinder liners carried by the wall 50' of the brake beam 10'. As best illustrated in FIG. 16, the housing representing the brake beam 10' has two identically constructed housing halves 52' as hollow castings which can be turned down symmetrically with respect to a center plane of the bogie 2' and of which each housing half 52', in sections, forms a cylinder 46' of a cylinder piston drive 20*a*', 20*b*'. These housing halves 52' are shown individually in FIG. 9, in which case the sections 54' of the housing halves 52' situated opposite one another in the mounted condition each have a cylindrical cross-section in order to form the cylinder face 48' on the interior circumferential surface. In addition, a flange 56' is shaped onto the end of the cylindrical section 54'. Toward the outside, the cylindrical section 54' is followed by a section 58' with an essentially rectangular cross-section and with a bag-type shaping-out 60' which extends transversely to a center axis 62' of the cylinder piston drives 20*a*', 20*b*' and in which one deflection gearing 64' respectively is accommodated for deflecting the piston movements taking place along the center axes 62' of the cylinder piston drives 20*a*', 20*b*' to the pressing rods 8' arranged perpendicular thereto. The above-mentioned fork-shaped receiving devices 38' for the brake shoes 16' are shaped onto the ends of the housing halves 52' pointing away from the flanges 56'. As best illustrated in FIG. 10, a two-shell intermediate housing 66' is arranged between the two housing halves 52', in which intermediate housing 66', a central pressure medium connection 70' is constructed which is visible in the sectional plane of FIG. 12*a*. The connection 70' supplies one pressure chamber 68' respectively of the cylinders 46' with pressure medium. The intermediate housing 66' is held between the housing halves 52', for example, by tie rods 72' applied to the flanges 56', which tie rods 72' are guided through passage bores of the intermediate housing 66'. The other brake beam 12' constructed without a brake actuator has a conventional construction, for example, that of a double-U profile, and is provided at the end side also with fork-shaped receiving device 38' for brake shoes 16', as illustrated in FIG. 7.

Figure 8:
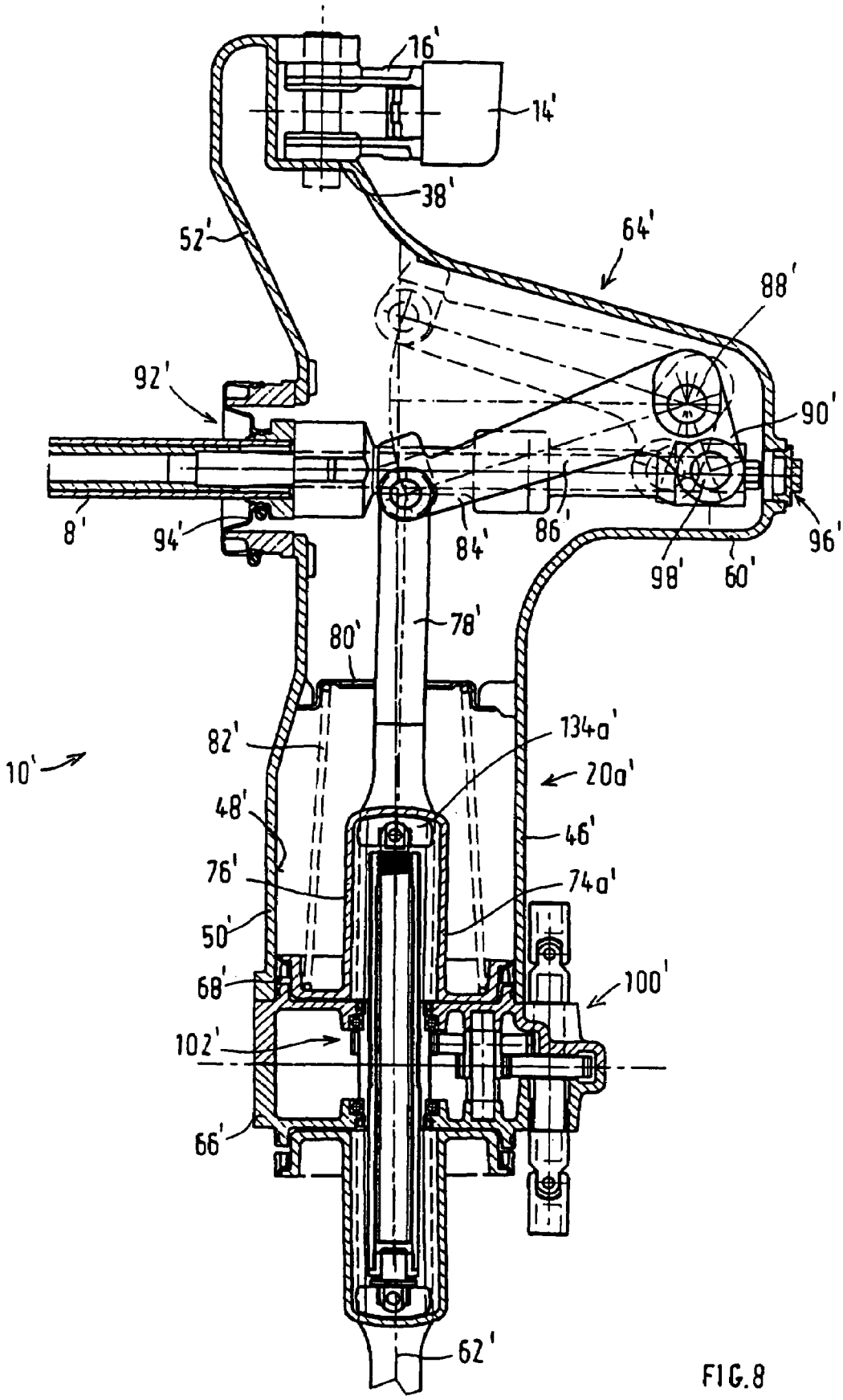
FIG. 8 is a sectional view of a portion of a brake beam with a cylinder piston drive of the shoe braking system.

For reasons of scale, FIG. 8 shows only one housing half 52'; however, the two housing halves 52', together with the subassemblies accommodated therein, have identical constructions. On their pressure side, the pistons 74*a*', 74*b*' of the cylinder piston drives 20*a*', 20*b*' each have a central cup-shaped shaping-out 76' from which, on the head side, a central piston rod 78' coaxial with the center axis 62', projects away to the outside. The pistons 74*a*, 74*b* are pretensioned in the release position by restoring springs 82' supported on intermediate bottoms 80' held in the housing halves 52'. The piston rod 78' is linked to a longer leg 84' of a two-leg angle lever 86', which, for example, forms the deflection gearing 64'. The angle lever 86' is completely enclosed by the bag-type shaping-out 60' of the corresponding housing half 52' and is swivellably disposed with respect to the latter by a bolt support 88'. The two legs 84', 90' of the angle lever 86' are approximately perpendicular to one another, the shorter leg 90' being linked to an end of the assigned pressing rod 8' which projects from an opening 92' of the housing half 52' arranged transversely to the center axis 62' of the cylinder piston drives 20*a*', 20*b*'. Depending on where the linking bore for the bolt support 88' of the angle lever 86' is arranged, a different transmission ratio can be achieved in each case, such as 4/1 or 3/1. Thus, a broad braking force spectrum is obtained for different rail vehicles without having to use different cylinder piston drives 20*a*', 20*b*' and particularly other cylinder diameters for this purpose, so that the shoe braking device 1' can be used as a standardized same-construction unit. For sealing the housing interior, a flexible sealing device 94' is provided between the pressing rod 8' and the housing half 52'. Furthermore, additional openings of the brake beam 10', for example, mounting openings 96, are closed by covers, so that the brake beam 10' forms a closed housing. As a result, the angle levers 86', together with their bolt support 88', the cylinder piston drives 20*a*', 20*b*' as well as the linked connections 98' of the pressing rods 8' to the angle levers 86' are disposed inside the brake beam 10' protected from dust, splashing water and mechanical effects. A wear adjusting device, whose construction and method of operation is known and therefore does not need to be explained, is in each case integrated in both pressing rods 8'.

Figure 12B:
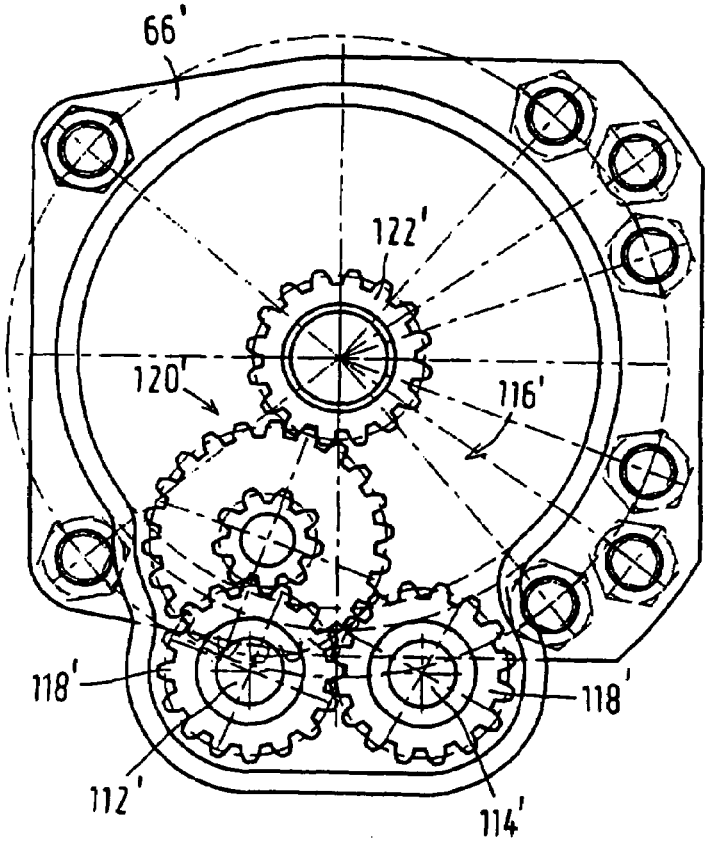
FIG. 12*b* is a sectional view along Line XIIb of FIG. 10.

As illustrated best in FIG. 10, in the intermediate housing 66' forming a portion of the brake beam 10', at least a portion of the actuating mechanism 100' of a parking brake is accommodated, which comprises a nut screw drive 102' which can be rotary driven by parking brake application elements and is coaxial with respect to the cylinder piston drives 20*a*', 20*b*'. Screw 104' is constructed so that it can strike against the pressure side of the piston 74*a*' of the one cylinder piston drive 20*a*'. Nut 106' is constructed so that it can strike against the pressure side of the piston 74*b*' of the other cylinder piston drive 20*b*'. For the application and release of the parking brake, for example, by hand wheels arranged on the lateral surface of the rail vehicle and not shown for reasons of scale, a rotating movement is introduced into preferably two universal-joint shafts 108' which extend parallel to the wheel axles 22' and which lead from both sides into a projecting continuation 110' of the intermediate housing 66' and are in a rotating connection there with one input shaft 112', 114' of the toothed gearing 116' respectively, which is illustrated best in FIG. 12*b*. Since, in practice, the parking brake is operated only from one side of the rail vehicle, the two input shafts 112', 114' carry mutually meshing spur gears 118', so that a rotating connection exists between the two universal-joint shafts 108'. In this case, the parking brake is applied by a right-hand rotation of the hand wheels 6 and is released by a left-hand rotation. For the transmission of the rotating movement to the nut screw drive 102', for example, two gear stages 120' are arranged behind the input shafts 112', 114', the output of the toothed gearing 116' taking place by way of a central gear 122' which is constructed in one piece (FIG. 10) with a coaxial cylindrical sleeve 126' disposed in the intermediate housing 66' preferably by a roller bearing 124'. As an alternative, the central gear 122' can also be shrunk fit onto the sleeve 126'. One movement sealing device 130' respectively is arranged between the ends of the sleeve 126' and the two bottoms 128' of the intermediate housing, in order to seal off the pressure chambers 68' of the cylinder piston drives 20*a*', 20*b*' axially adjoining on both sides with respect to the interior of the intermediate housing 66'.

Figure 11:
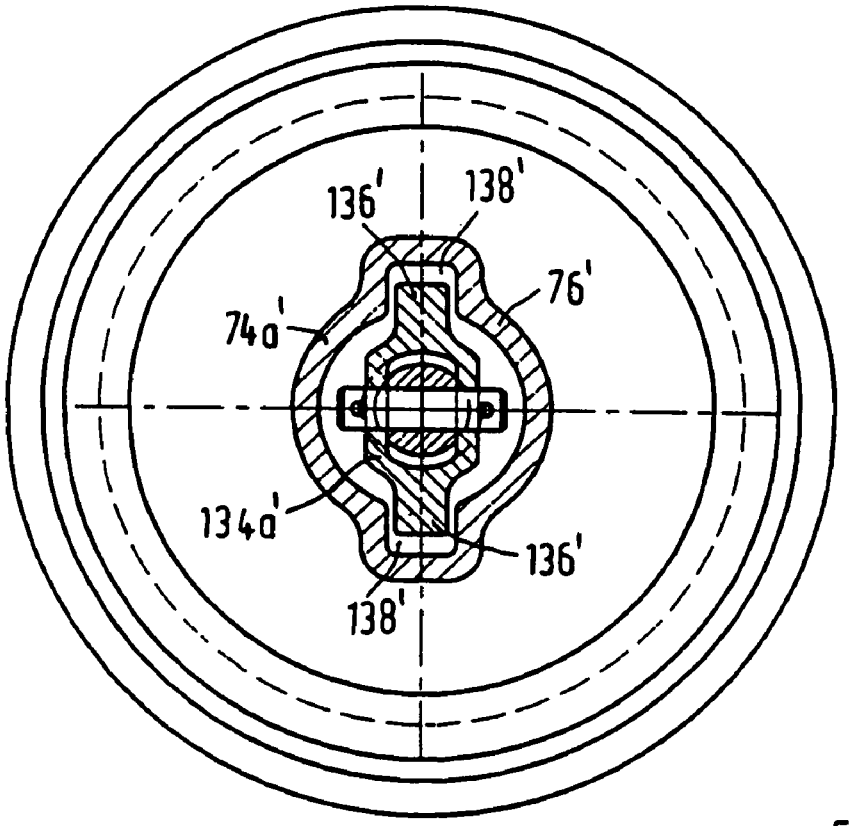
FIG. 11 is a sectional view along Line XI-XI of FIG. 10.

As best illustrated in FIG. 10, the sleeve 126' encloses the nut 106' of the nut screw drive 102' and is non-rotatably connected with this nut 106'. In addition, the nut 106' is axially displaceably accommodated inside the sleeve 126'. This can be implemented, for example, in that a coupling takes place between the sleeve 126' and the nut 106' by a splined shaft profile 132' or an adjusting spring. As a result, the entire nut screw drive 102' is disposed to be axially displaceable or floating with respect to the sleeve 126' in the direction of the center axis 62' of the cylinder piston drives 20*a*', 20*b*'. Furthermore, the screw 104' and the nut 106' of the nut screw drive 102' are linearly displaceably guided within the cup-shaped shaped-out sections 76' of the assigned pistons 74*a*', 74*b*', as illustrated in the sectional view of FIG. 11. This is implemented, for example, in that the screw 104' and the nut 106' are provided on the end side with one stop body respectively 134*a*', 134*b*' with preferably symmetrical lateral wings 136' which engage in complementarily shaped grooves 138' extending in the axial direction, which grooves 138' are constructed on the interior surfaces of the shaped-out sections 76' of the pistons 74*a*, 74*b*. The stop body 134*a*' assigned to the screw 104' is non-rotatably connected with the latter, while the stop body 134*b*' assigned to the nut 106' is connected with a shaft end 140' which is rotatably, with respect to a sleeve-shaped end piece 144' coupled with the nut 106', for example, by an axial needle bearing 148'. The screw 104' of the nut screw drive 102' can be screwed inside the nut 106 by means of a thread 150' so that a rotation of the sleeve 126' introduced by way of the toothed gearing 116' causes a screwing of the screw 104' relative to the nut 106', whereby the nut screw drive 102' is lengthened or shortened. In addition to the function as a guiding element for the screw 104' and the nut 106' or as a protection against torsion for the screw 104', these stop bodies 134*a*, 134*b* carry out another function as driving devices for the pistons 74*a*, 74*b* in the case of a parking braking. For this purpose, the stop bodies 134*a*', 134*b*' are shaped on the head side in a complementary manner to the assigned bottoms 152' of the shaped-out sections 46' of the pistons 74*a*', 74*b*', for example, in a spherical shape. As a result, the described actuating mechanism 100' of the parking brake acts directly upon the pistons 74*a*', 74*b*' of the cylinder piston drives 20*a*', 20*b*' applying the service brake.

FIG. 10 shows the release position of the service brake and the parking brake, in which, in the moved-in position, the two pistons 74*a*', 74*b*' contact the bottoms 128' of the intermediate housing 66'. In this case, the stop bodies 134*a*', 134*b*' contact the bottoms 152' of the pistons 74*a*', 74*b*' in the shaped-out sections 76'.

Figure 13:
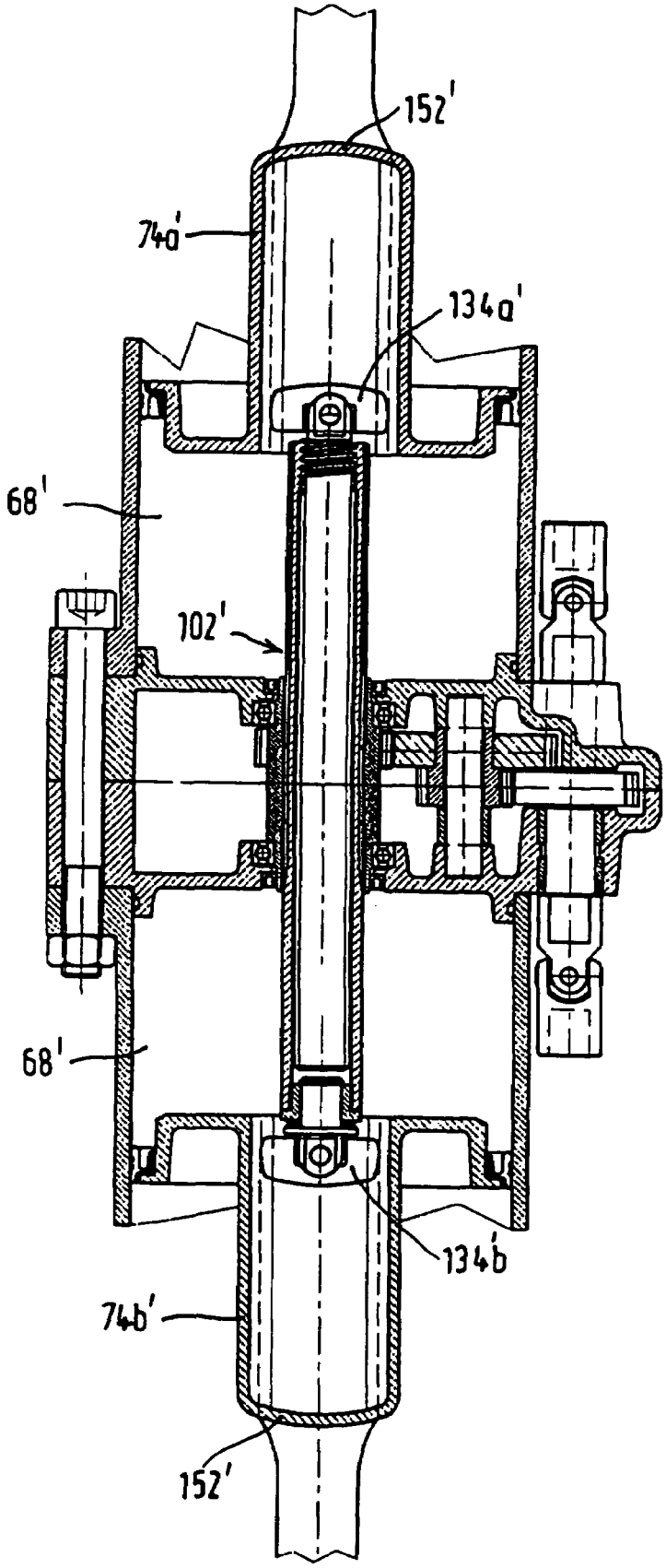
FIG. 13 is a sectional view of the cylinder piston drives of FIG. 10 with the parking brake released and the service brake applied.

FIG. 13 shows the situation in which the service brake is applied by the admission of pressure to the pressure chambers 68' of the cylinder pistons drives 20*a*', 20*b*, but the parking brake is still released. Correspondingly, during a service braking, the two pistons 74*a*', 74*b*' move against the effect of the restoring springs 82', similar to an opposed-cylinder arrangement, away from one another toward the outside and, by way of the piston rods 78' and the angle levers 86', operate the pressing rods 8', whereby the two brake beams 10', 12' are pressed away from one another and the brake blocks 14' are pressed against the braking areas of the wheels 6'. Since the parking brake was not applied, the nut screw drive 102' is still in the screwed-in position, in which case the stop bodies 134*a*', 134*b*' are away from the assigned bottoms 152' of the shaped-out sections 76' of the pistons 74*a*', 74*b*'.

Figure 14:
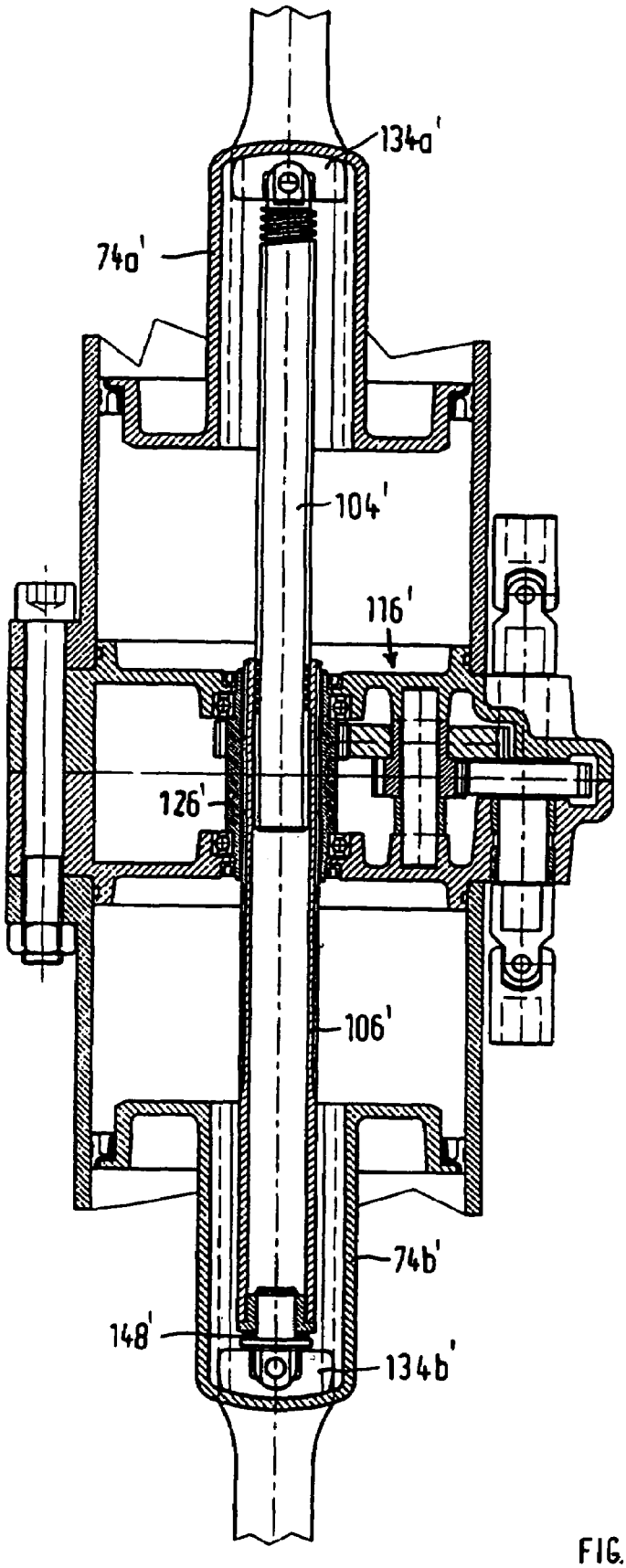
FIG. 14 is a sectional view of the cylinder piston drives of FIG. 10 with the parking brake applied.

In contrast, in the position according to FIG. 14, the parking brake is in the application position because, as a result of a rotating movement introduced into the toothed gearing 116', the sleeve 126' is caused to rotate and, as a result, the nut 106', which is freely rotatable with respect to its stop body 134*b*' by means of the axial needle bearing 148', was screwed with respect to the screw 104' which is protected against torsion by means of its stop body 134*a*'. As a result, the nut screw drive 102' was lengthened on both sides, in which case, the longitudinal force was transmitted by way of the stop bodies 134*a*', 134*b*' to the pistons 74*a*', 74*b*', and the latter were then pushed toward the outside against the effect of the restoring springs 82' and, as described in the case of the service braking, the brake blocks 14' were moved into the brake engaging position. The situation of FIG. 14 can also be caused in that first the service brake and then additionally the parking brake is applied.

Figure 17:
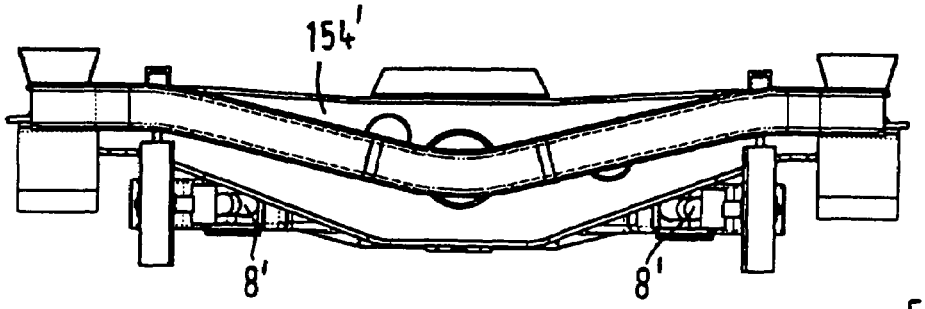
FIG. 17 is a frontal view of the bogie of FIG. 11.

In the additional embodiments of the present disclosure according to FIGS. 16 and 17, the parts remaining the same as in the preceding embodiments and have the same effect are indicated by the same reference numbers. In the embodiment according to FIG. 7, the pressing rods 8' arranged perpendicular to the brake beams 10', 12' are guided below a cross member of the bogie. In contrast, in the embodiment according to FIGS. 16 and 17, the pressing rods 8' are arranged at an angle with respect to one another and diverge preferably starting from the one brake beam 10' in which the cylinder piston drives 20*a*', 20*b*' are accommodated. As a result, the pressing rods 8' can be guided on the right and the left past a central downward-pulled section of a cross member 154' of the bogie 2'. As an alternative, the pressing rods 8' can also be guided through passage openings in the cross member 154' (not shown). In the latter case, it is necessary that the pressing rods 8' can easily be separated from the brake actuators 20*a*', 20*b*' for the mounting and demounting of the shoe braking device 1'. The parking brake has a construction analogous to the embodiment of FIG. 2.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A brake system of a rail vehicle, comprising:

a parking brake device having a gearing which converts a rotating movement initiated by rotation-actuating devices into an application movement of at least one pressure-medium-operated cylinder piston drive;

at least one universal-joint shaft connecting the rotation-actuating devices with a gearing input of the gearing;

the gearing input being disposed in the direct vicinity of the at least one pressure-medium-operated cylinder piston drive and connected to a nut screw drive converting a rotating movement at a gearing output of the gearing to a linear movement of a piston of the at least one pressure-medium-operated cylinder piston drive;

wherein the at least one universal-joint shaft includes two universal joint shafts, and the rotation-actuating devices include rotatably disposed hand wheels at two rail vehicle sides, the rotation-actuating devices having an axis of rotation essentially perpendicular with respect to a longitudinal dimension of the rail vehicle, and which rotation-actuating devices are each non-rotatably connected with one of the universal-joint shafts; and wherein an intermediate gearing converting the rotating movements of the hand wheels caused by the at least one universal-joint shafts to a rotating movement of at least one additional universal-joint shaft connected with a gearing input of the gearing is arranged between the gearing and the hand wheels.

2. The braking system according to claim 1, wherein the at least one universal-joint shaft is arranged essentially in a plane perpendicular to a longitudinal dimension of the rail vehicle.

3. The braking system according to claim 1, wherein the gearing and the nut screw drive are one of integrated in a housing of the at least one pressure-medium-operated cylinder piston drive and combined with the at least one pressure-medium-operated cylinder piston drive in a constructional unit.

4. The braking system according to claim 1, wherein the gearing has two gearing inputs which are arranged mutually offset by 180 degrees and each of which is non-rotatably connected directly by one of the universal-joint shafts with one of the hand wheels.

5. The braking system according to claim 1, wherein one of the at least one universal-joint shaft is an input-side universal-joint shaft, and the at least one additional universal-joint shaft is an output-side universal-joint shaft, and the intermediate gearing is constructed such that it converts rotating movements of the at least one input-side universal-joint shafts in the same direction to a rotating movement of the at least one output-side universal-joint shafts.

6. The braking system according to claim 1, wherein the at least one pressure-medium-operated cylinder piston drive extends essentially in a direction of a longitudinal dimension of the rail vehicle.

7. The braking system according to claim 1, wherein the gearing includes a bevel gearing deflecting a rotating movement of one of the at least one additional universal-joint shafts and the at least one universal joint shafts to a rotating movement about an axis parallel to the piston.

8. The braking system according to claim 7, wherein the bevel gearing has at least one bevel pinion non-rotatably connected with an end of the at least one universal-joint shaft and a bevel gear meshing with the bevel pinion.

9. The braking system according to claim 8, wherein a nut of the nut screw drive is non-rotatably connected with the bevel gear of the bevel gearing, and a screw of the nut screw drive is constructed so that it can strike against the piston.

10. The braking system according to claim 9, wherein the screw of the nut screw drive is couplable with the piston by a cone clutch.

11. The braking system according to claim 9, wherein the screw of the nut screw drive is axially displaceable but non-rotatable with respect to the piston that is non-rotatably supported at a housing.

12. The braking system according to claim 1, wherein the at least one pressure-medium-operated cylinder piston drive includes multiple cylinder parts accommodating at least two pistons.

13. The braking system according to claim 1, wherein the at least one pressure-medium-operated cylinder piston drive extends essentially perpendicular to a longitudinal dimension of the rail vehicle.

14. The braking system of claim 1, wherein the gearing includes a toothed gearing.

15. The braking system according to claim 1, wherein the gearing includes a bevel gearing deflecting a rotating movement of one of the at least one additional universal-joint shafts and the at least one universal-joint shafts to a rotating movement about an axis coaxial to the piston.

16. A brake system of a rail vehicle, comprising:

a parking brake device having a gearing which converts a rotating movement initiated by rotation-actuating devices into an application movement of at least one pressure-medium-operated cylinder piston drive;

at least one universal-joint shaft connecting the rotation-actuating devices with a gearing input of the gearing;

the gearing input being disposed in the direct vicinity of the at least one pressure-medium-operated cylinder piston drive and connected to a nut screw drive converting a rotating movement at a gearing output of the gearing to a linear movement of a piston of the at least one pressure-medium-operated cylinder piston drive;

wherein the gearing is formed by a spur gearing which, on an output side, drives an axially fixed and rotatably disposed sleeve in which a nut of the nut screw drive is disposed in an axially displaceable and rotatable manner; and wherein the at least one pressure-medium-operated cylinder piston drive includes two pressure-medium-operated cylinder piston drives which operate in opposite directions and which pressure-medium-operated cylinder piston drives are coaxial.

17. The braking system according to claim 16, wherein a screw of the screw nut drive is constructed so that it is adapted to strike against a pressure side of a first piston of one of the two pressure-medium-operated cylinder piston drives, and the nut of the screw nut drive is constructed so that it is adapted to strike against a pressure side of a second piston of the other of the two pressure-medium-operated cylinder piston drives.

18. The braking system according to claim 17, wherein the screw, while being protected against torsion, is linearly displaceably disposed on the first piston of one of the two pressure-medium-operated cylinder piston drives, and the nut is linearly displaceably but freely rotatably disposed on the second piston of the other pressure-medium-operated cylinder piston drive.

19. The braking system according to claim 17, wherein the screw and the nut are guided within one centric cup-shaped shaped-out section in each of the first and second pistons.

20. The braking system according to claim 19, wherein the screw and the nut are provided on an end side of the first and second pistons with one stop body, respectively, shaped complementarily with respect to a bottom of the centric cup-shaped shaped-out sections of the pistons.

21. The braking system according to claim 16, wherein the parking brake device is constructed as a shoe braking device fastened by hanging lugs to a bogie and including two brake beams, each assigned to a wheel axle with two wheels and extending essentially parallel to the wheel axle, and which brake beams are connected with one another by way of pressing rods and carry brake blocks which are movable into a braking engagement with assigned braking areas of the wheels by actuating the pressure-medium-operated cylinder piston drives.

22. The braking system according to claim 21, wherein at least a portion of one of the two brake beams directly forms cylinders of the pressure-medium-operated cylinder piston drives.

23. The braking system according to claim 22, wherein one of the two brake beams additionally forms a housing for the gearing and for the nut screw drive.

24. The braking system according to claim 23, wherein one of the two brake beams has two identically constructed housing halves which can be symmetrically folded over with respect to a center plane of the bogie and which, at least in sections, form the cylinders of the pressure-medium-operated cylinder piston drives.

25. The braking system according to claim 24, wherein the gearing and at least a portion of the nut screw drive are accommodated in an intermediate housing arranged between the housing halves, which intermediate housing forms a section of one of the two brake beams.

* * * * *